US012781501B2

(12) United States Patent
Tao

(10) Patent No.: US 12,781,501 B2
(45) Date of Patent: Nov. 3, 2026

(54) COLD-FORMED-STEEL CONCRETE COMPOSITE SLAB WITH CAST-IN FINGERS

(71) Applicant: Jianlin Tao, Richmond Hill (CA)

(72) Inventor: Jianlin Tao, Richmond Hill (CA)

( * ) Notice: Subject to any disclaimer, the term of this patent is extended or adjusted under 35 U.S.C. 154(b) by 164 days.

(21) Appl. No.: 18/445,974

(22) Filed: Apr. 24, 2024

(65) Prior Publication Data

US 2025/0333958 A1 Oct. 30, 2025

(51) Int. Cl.
*E04C 2/52* (2006.01)
*E04B 5/14* (2006.01)
*E04B 5/48* (2006.01)

(52) U.S. Cl.
CPC ..... *E04B 5/14* (2013.01); *E04B 5/48* (2013.01)

(58) Field of Classification Search
CPC ..... E04B 5/14; E04B 5/48; E04B 5/10
See application file for complete search history.

(56) References Cited

U.S. PATENT DOCUMENTS 1,936,147 A * 11/1933 Young ..... E04C 3/294 52/289
2,088,781 A * 8/1937 Folsom ..... E04C 3/32 52/634
3,841,597 A * 10/1974 Butts ..... E04G 17/18 249/210
3,979,868 A * 9/1976 Butts ..... E04B 5/32 52/334
4,909,007 A * 3/1990 Bodnar ..... E04B 5/29 52/634
4,930,278 A * 6/1990 Staresina ..... E04F 13/0862 52/600
5,669,197 A * 9/1997 Bodnar ..... E04B 5/29 52/842
2011/0061336 A1* 3/2011 Thomas ..... E04B 1/10 52/745.19
2013/0187308 A1* 7/2013 Stal ..... E04B 1/24 52/356
2013/0232911 A1* 9/2013 Stal ..... E04C 3/293 52/837

* cited by examiner

*Primary Examiner* — Basil S Katcheves

(57) ABSTRACT

The present invention revolutionizes the construction of composite slabs by introducing a novel design that integrates cold-formed steel and wire-mesh-reinforced concrete (CFS-WMRC). This innovative design significantly reduces the slab's weight and thickness while enhancing structural integrity and resistance to environmental stresses. The invention's core features modified steel joists with unique connector 'fingers' in place of traditional top flanges, optimized for direct concrete casting and load distribution. The joists, equipped with utility holes, facilitate the incorporation of HVAC systems, contributing to structural support and space efficiency. Prefabrication techniques are employed to assemble the joists and mesh off-site, where they are subsequently cast with concrete, ensuring consistent quality and accelerating construction timelines. The incorporation of these advanced methodologies results in improved structural performance, reduced construction costs, and an environmentally resilient building component suitable for diverse architectural applications, including the extension into balcony slabs.

20 Claims, 9 Drawing Sheets

COLD-FORMED-STEEL CONCRETE COMPOSITE SLAB WITH CAST-IN FINGERS

FIELD

The present invention generally relates to the field of construction materials and, more specifically, to composite slabs comprising cold-formed-steel and Wire-Mesh-Reinforced Concrete slabs (CFS-WMRC CS). These slabs are designed for use in residential, commercial, and industrial buildings' floors and roofs, offering enhanced structural performance, durability, and construction efficiency.

BACKGROUND

In the construction industry, the use of composite materials for building structural components such as floors, roofs, and walls is increasingly prevalent. Composite slabs, which combine different materials to exploit the advantageous properties of each, have become particularly important in modern construction practices. Cold-formed steel (CFS) and concrete are two commonly used materials in the construction of composite slabs. CFS is appreciated for its high strength-to-weight ratio, ease of installation, and versatility. Concrete, particularly when reinforced with fibers, provides excellent compressive strength and durability, making it an ideal material for resisting loads and environmental stresses.

Traditionally, steel-concrete composite slabs have utilized hot-rolled steel sections in combination with conventional reinforced or pre-stressed concrete. While effective, these systems have limitations, including the weight of the hot-rolled steel sections, the labor-intensive nature of their installation, and the limitations imposed by the concrete's curing time and the need for extensive formwork.

Recent developments have seen the introduction of cold-formed steel as an alternative to hot-rolled steel for use in composite slab systems. Cold-formed steel sections are produced at room temperature, allowing for a wider range of shapes and sizes and resulting in material that is lighter and easier to handle than hot-rolled steel. This innovation has led to the development of more efficient and versatile composite slab systems. However, the integration of cold-formed steel with concrete presents unique challenges. These include ensuring adequate bond strength between the steel and concrete, managing differential shrinkage and thermal expansion, and optimizing the structural design to leverage the benefits of both materials effectively.

Concrete, as a common structural material, has remarkable properties in terms of compressive strength, sustainability, and cost-effectiveness. Wire mesh (WM) is prized for its uniform strength distribution and ability to prevent the expansion of small cracks. WM acts as reinforcement, allowing the concrete board to resist bending, twisting, and cracking under significant loads. The application of wire mesh reinforced concrete in composite slabs with cold-formed steel framing seeks to address the demand for lighter, more durable, and efficiently constructed building components.

Despite the advantages offered by combining cold-formed steel with Wire-Mesh-Reinforced concrete, there is a need for further innovation in this area. Current systems often fall short in a better load-bearing capacity, strength; and durability, resistance to environmental stresses like mold, mildew, and fire hazards, optimizing the interface between these materials, handling the complexities of their different mechanical properties such as weight, thickness, cracking, and sound insulation; and addressing practical construction challenges such as assembly difficulty, low cost-effectiveness, long construction time, and installation time.

The present disclosure provides a new design of a cold-formed-steel and concrete composite slab, as well as a new method of manufacturing it. The present invention tries to address some of the above-mentioned major shortcomings and improves in the following: (1) further significantly reduce weight and thickness; (2) improves structural design performance, durability, reliability, load capacity, cracking control, and efficiency; (3) reduce labor and material costs; easier to install; faster speed of construction; (4) improves resistance against fire, sound, mold, mildew, etc. weather and environmental damages; (5) improves dimensional accuracy and controlled indoor manufacturing process.

SUMMARY

This invention presents an innovative design for a composite slab with cast-in fingers, which is composed of cold-formed steel and wire mesh reinforced concrete (CFS-WMRC), along with a novel method for its fabrication. These slabs are designed for use in residential, commercial, and industrial buildings' floors and roofs, offering enhanced structural performance, durability, and construction efficiency. The CFS framing for floor slabs can be designed to be thinner than the floor and roof slabs so that it can be used as a wall slab. The new design marks a significant advancement over conventional composite slabs by achieving a reduction in weight and thickness, enhancing various structural parameters such as performance, durability, reliability, load-bearing capacity, and cracking control. Furthermore, the invention is designed to streamline installation and construction processes, substantially reduce labor and material costs, and fortify the structure's resistance to fire, acoustics, and environmental elements. Also, the inherent properties of Cold-Formed Steel (CFS) contribute to superior dimensional accuracy, enabling a more controlled manufacturing process. This enhanced dimensional control ensures higher quality assurance across the production lifecycle. The complete indoor manufacturing environment and CNC cutting/punching/roll-forming process of CFS further improve quality assurance by minimizing exposure to external variables that can affect material properties. Consequently, this controlled setting allows for the production of components with consistently high precision and reliability.

The construction process involves an array of specially adapted cold-formed steel framing joists, aligned in parallel, with conventional top flanges replaced by an assortment of uniquely designed connectors, referred to as 'fingers.' These fingers are devised to integrate seamlessly into the concrete board or concrete layer, contributing to the overall stability of the slab. The joists are interconnected, forming the complete perimeter of the slab. For additional support and rigidity, blocking plates are positioned between the joists. The joists and blocking plates are manufactured using a material selected from a group consisting of galvanized steel, stainless steel, or a coated alloy.

Above the framework of joists and blocking plates, a wire mesh is strategically placed and secured, upon which concrete is poured to form the slab. Each joist is punctuated with utility holes to accommodate HVAC systems, optimize space utilization, and provide supplementary support. Additionally, resilient strips are affixed to the bottom flange of the joists to improve the sound performance.

This disclosure delineates several key aspects of the invention: (1) the use of modified joists without top flanges, incorporating multiple connectors in lieu of a singular flange and along with blocking plates; (2) direct casting of concrete onto the modified joists in (1) with wire mesh reinforcements; (3) the option to extend the slab into a balcony using balcony joists and a balcony rim joist; (4) an efficient prefabrication method for the novel composite slab suitable for factory production; and (5) a seamless integration of HVAC piping through the joists' utility holes, enhancing space efficiency, and structural support.

The initial aspect of this invention relates to an enhanced design of joists and blocking plates, which are integral to the composite slab's structure. These components are fabricated from cold-formed steel and are distinct in that they feature a bottom flange while forgoing the traditional top flange. In its place, a series of innovative connectors or 'fingers' adorn the top edge. These connectors are not limited to a single form; while a wavelike contour is standard, they can be adapted into diverse shapes to suit various applications, enhancing the interface with the concrete. Both the joists and blocking plates are perforated with utility holes strategically designed to accommodate HVAC systems and other utilities, ensuring efficient use of space and additional structural support.

In the second aspect, the innovation lies in the application of direct concrete casting onto the modified joists and blocking plates. The absence of a top flange is counterbalanced by the presence of the specially designed connectors, which not only secure the wire mesh in place but also support the concrete poured atop. This configuration allows the concrete to act as the primary compression element, with the wire mesh reinforcements distributing tensile stresses across the slab. This approach negates the need for traditional reinforcement methods, streamlining the construction process.

The third aspect of this disclosure expands on the application of these modified joists and blocking plates in the construction of balcony slabs. By leveraging balcony joists with the blocking plates in the inner slab section, a balcony slab can be seamlessly integrated into the overall building structure, maintaining the aesthetic and functional continuity of the design.

The fourth aspect details a prefabrication method for the cold-formed-steel and concrete CFSC composite slab, enhancing efficiency and precision. This process takes place off-site, where the cold-formed steel components, such as joists and blocking plates, are accurately cut, shaped, and assembled. Each can be produced in pairs. During the cutting production process, one joist (or blocking plate) and another piece are engineered to engage in an interlocking arrangement with another by inverting their orientation, e.g., flipped left-hand-side (LHS) with right-hand-side (RHS). The fingers on the left-hand-side joists are cut from the joists on the right-hand-side and vice versa. They are then spot-welded, riveted, or screwed together with the specialized connectors, and the wire mesh is affixed on top. This assembly is inverted onto a casting bed, where concrete is poured and cured to form the robust top layer of the slab. Concurrently, HVAC piping is meticulously installed, ensuring seamless integration with the slab's structure, increased strength, and better space utilization efficiency. Resilient strips are strategically placed between the joists for further soundproofing and ease of installation. When sound energy passes through an assembly, it can be impacted by various factors, including the stiffness of individual elements within the assembly. The concept of the resilient strip (channel) focuses on decoupling, which helps reduce the transmission of sound energy. By using resilient strips, we aim to minimize the transfer of vibrations and sound waves from one side of the assembly to the other. Also, this softness makes it easier for screws to penetrate thinner resilient strips than thicker CFS joists.

The fifth aspect focuses on maximizing the utility of the slab space by incorporating HVAC piping as an element of structural support, which is inherently connected to the first aspect of the invention. The concrete layer is only cast on the top portion of the joists and blocking plates, leaving the slab's inner space mostly unoccupied. The joists and blocking plates, featuring utility holes in the middle of the webs, accommodate the HVAC piping, which is welded to the joists for added rigidity. The HVAC system includes transverse and vent pipes that facilitate air circulation, crafted from cold-formed steel to complement the joist's utility holes perfectly.

By incorporating these innovative technologies, the use and installation of composite slabs are significantly enhanced, delivering a multitude of benefits: (1) The inventive joist design and manufacturing method markedly reduce labor and material costs. (2) The durability, structural performance, and efficiency of the building are elevated through the unique joist design, the method of direct concrete casting, and the strategic use of HVAC piping. (3) The modified joist design contributes to an overall reduction in slab weight. (4) The prefabrication method accelerates construction timelines and improves dimensional accuracy and a more controlled manufacturing process. (5) The joists' advanced design bolsters the structure's resilience to environmental stressors. (6) The highly precise CFS frame enhances building quality and increases the installation speed.

BRIEF DESCRIPTION OF THE DRAWINGS

The included drawings are integral to comprehending the invention, forming part of this submission and illustrating various embodiments as described herein. They are designed to communicate the concept of the invention clearly and are not necessarily to scale; certain dimensions may be exaggerated to improve clarity. The figures demonstrate the general construction approach of the embodiments, and to maintain focus on the novel aspects of the present invention, common techniques and features may not be detailed. Together, the drawings and the descriptive text explain the underlying principles of the disclosed invention.

DETAILED DESCRIPTION

Figure 1:
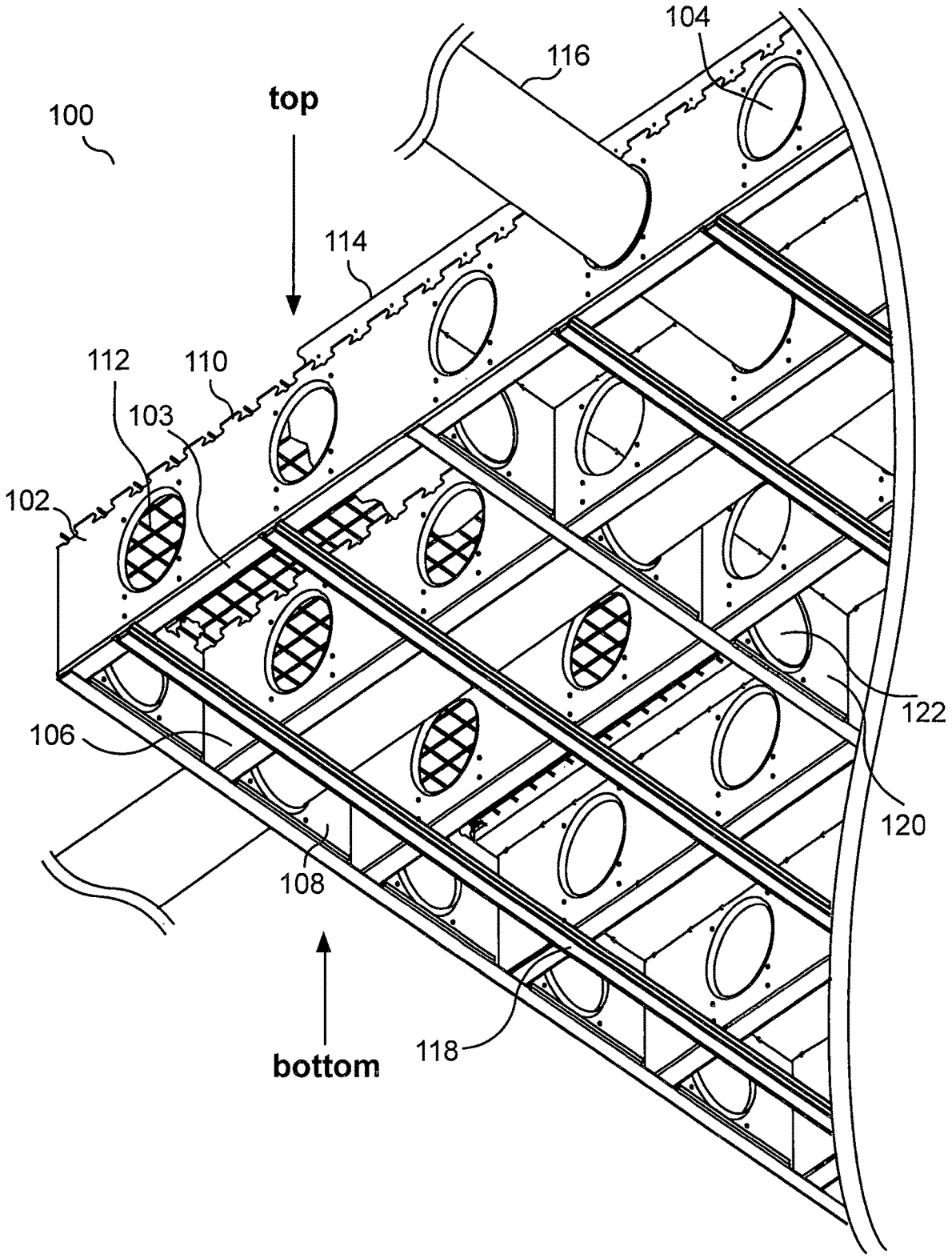
FIG. 1 presents a bottom perspective view of a corner of the composite slab composed of cold-formed steel and concrete, as per the preferred embodiment of the invention.

This disclosure details innovative methods and systems for an online platform that facilitates virtual reality-based social interactions. While various embodiments of this invention are depicted in the accompanying figures, the scope of the invention extends beyond these specific instances. Detailed descriptions are provided for thorough understanding, but those skilled in the art will recognize that the disclosed concepts may be practiced without these specifics. The embodiments shown are exemplary, and the invention is not confined to them.

The language used herein is for descriptive purposes and is not limited to the explicit embodiments of the disclosure. The pronouns "they," "he/she," and "he or she" are used interchangeably and are to be taken as singular gender-neutral pronouns. The terms "comprise" and "comprising" are inclusive, indicating the inclusion of the described features, steps, operations, elements, and components, but do not preclude the addition of others.

All terms used, unless defined differently, are to be interpreted as commonly understood by those with ordinary skills in the relevant arts. These terms should be read in the context of the art and this disclosure and not interpreted with undue rigidity. A multitude of techniques and steps, each with its advantage, are disclosed and can be combined in various ways. To maintain clarity, the description does not enumerate every possible combination, but it should be understood that such combinations fall within the disclosure's breadth. Detailed references will now be made to certain embodiments of the invention, as exemplified in the accompanying figures.

The present invention introduces an advanced composite slab design composed of cold-formed steel and Wire-Mesh-Reinforced concrete (CFS-WMRC) with cast-in fingers, offering a transformative approach to slab construction. These slabs are designed for use in residential, commercial, and industrial buildings' floors and roofs, offering enhanced structural performance, durability, and construction efficiency. The CFS framing can be designed to be thinner than the floor and roof slabs so that it can be used as a wall slab. The novel composite slab design is a significant leap forward from traditional composite slabs, delivering a more efficient structural solution that is both lighter and thinner without sacrificing performance. The innovation lies in its ability to enhance structural parameters, such as overall performance, durability, reliability, load-bearing capacity, and control over crack propagation. Additionally, the invention simplifies and streamlines the installation and construction processes, substantially cutting down on labor and material costs while simultaneously increasing the structure's resistance to fire, acoustic disturbances, and various environmental factors. The inherent properties of Cold-Formed Steel (CFS) contribute to superior dimensional accuracy, enabling a more controlled manufacturing process. This enhanced dimensional control ensures higher quality assurance across the production lifecycle. The complete indoor manufacturing environment of CFS further improves quality assurance by minimizing exposure to external variables that can affect material properties. Consequently, this controlled setting allows for the production of components with consistently high precision and reliability.

The present disclosure is the first aspect of the invention, which relates to an enhanced design of joists and blocking plates, which are integral to the composite slab's structure. It includes the Joists and Blocking Plates Configuration, Innovation in Joists and Connectors, and Wire Mesh and Concrete Casting. They are elaborated on below.

Joists and Blocking Plates Configuration

Central to the novel cold-formed steel and wire-mesh-reinforced concrete (CFS-WMRC) slab construction is the specially adapted cold-formed steel framing joists and blocking plates to form a waffle structure. The invention details an enhanced design of the joists and blocking plates, which are pivotal to the integrity of the composite slab's structure. These joists are lined up parallel to one another. These components are constructed using cold-formed steel and feature a bottom flange, notably omitting the traditional top flange. Instead, the joists are designed with slots punched at their top side, resembling "fingers", which serve as connectors. The top edge is then outfitted with a series of these "fingers" connectors. These "fingers" are designed to connect seamlessly to the concrete layer after pouring, thus enhancing the stability, durability, and integrity of the slab. The joists are linked and securely welded, riveted, or screwed to form the slab's complete perimeter, and blocking plates are interspersed between the joists to furnish additional support and reinforce the structural rigidity of the assembly. The blocking plate can be considered a secondary structural support in the waffle structure under the following conditions: 1) The blocking plates must have sufficient density. 2) The flange beneath the blocking plates must be reliably connected to the flange beneath the joists, for instance, through welding or by using a full-length U-shaped steel for reinforcement. Only with such reinforcement can the blocking plate approximate the strength of the joists, forming the waffle structure. In the present disclosure, the blocking plates are also connected to the wire-mesh-reinforced concrete board or layer through their top finger connectors, as explained below.

Additionally, resilient strips are also appended to the bottom flange of the joists. The joists and blocking plates are manufactured using a material selected from a group consisting of galvanized steel, stainless steel, or a coated alloy.

Innovation in Finger Connectors

The keys to the present invention are the specially adapted cold-formed steel framing joists and blocking plates. Diverging from traditional design by eschewing the conventional top flanges for the series of meticulously engineered connectors known as 'fingers.' These connectors or fingers are versatile, with the ability to be customized into various shapes to facilitate different construction needs, thus improving the interaction between the steel and concrete components. The design of the cast-in finger connector offers the following features: (1) Optimized Material Usage. The two joists equipped with slotted connectors are split using a shearing process, resulting in optimized material usage and reduced waste. (2) Strong horizontal connection. When the top connector is locked in place due to the advantage of the slab, there is no need for the welding process to attach the wire mesh. (3) Dual Joist Production. This design allows for the production of two joists simultaneously. (4) Edge Usage Precaution. The edge connectors are cased into the concrete slab at the edge of the joists. This type of design offers a superior wave-edge connector that there is no need for.

Wire Mesh-Reinforced Concrete and Utility Holes

Positioned above the joist and blocking plate framework, as outlined in the invention, is a wire mesh that is securely fastened in place. This mesh serves as a reinforcement layer for the concrete that is subsequently poured over it, forming the principal component of the slab. The placement of the reinforcing mesh enhances the integrity between the mesh, the concrete slab, and the joists, thus increasing the overall strength.

The joists themselves are designed with utility holes at regular intervals, which serve the dual purpose of accommodating HVAC systems and optimizing space utilization. These HVAC pipes and holes also contribute additional structural support.

Direct Concrete Casting Technique

The second aspect of the innovation encompasses the application of direct concrete casting onto the modified joists and blocking plates. The unique design of the connectors compensates for the absence of a top flange, securing the wire mesh in place and bolstering the concrete that is poured over it. The Wire-Mesh-Reinforced concrete layer or concrete board only covers a thin layer of the top portion of the joists and blocking plates, leaving most of the slab's inner space unoccupied. The joists and blocking plates, featuring utility holes in the middle of the webs, accommodate the HVAC piping, which is welded, riveted, or screwed to the joists for added rigidity. This arrangement enables the concrete to serve as the primary compressive force bearer, with the mesh effectively distributing the tensile stresses throughout the slab. This method streamlines the construction process by bypassing the need for traditional reinforcement methods. By incorporating the blocking system with direct concrete, reliable support in multiple directions is achieved. The exceptional bond between the blocking plates and the concrete joists serves as the primary direction of load-bearing capacity. This enables the creation of a wall-like, directional supporting system, which enhances structural stability.

Balcony Slab Integration

Further expanding the application of this invention, the third aspect allows for the construction of balcony slabs by employing balcony joists or rim joists along the direction of the slab blocking plates. This feature enables a seamless extension of the composite slab into a balcony, maintaining the design's aesthetic appeal and functionality. The balcony joist consists of a slotted section that interlocks with the balcony plates and a wider section that serves as the main connection to the building or balcony plate and balcony/joist. The arrangement of the joist and the balcony plates creates an interconnected supporting system. Where the balcony plate and balcony/joist meet, it provides a reinforced vertical plane that enhances the overall structural stability. This design allows for easy adjustment of the balcony section during the construction phase and ensures that the balcony is properly aligned with the rest of the building.

Prefabrication Method

The fourth aspect of the invention delves into a prefabrication method that enhances the efficiency and precision of creating the CFS-WMRC composite slab. This prefabrication process occurs off-site, where the components, such as joists and blocking plates, are meticulously cut to specification, shaped, and arranged. They are then securely spot-welded, riveted, or screwed together with the specialized connectors, and the wire mesh is affixed on top. The assembled structure is inverted onto a casting bed where the concrete is poured and allowed to cure, forming the robust top layer of the slab. During this phase, HVAC piping is also installed and welded to the joists, ensuring an integrated structural and environmental control system. Additionally, resilient strips are placed between the joists at the bottom of the slab to provide superior acoustic insulation. Prefabrication enables quick assembly on construction sites, and it is dimensionally stable, meaning it does not warp, split, crack, or creep when exposed to the elements or over time. Its lightweight nature reduces the load on the foundation and other structural components, leading to potential cost savings in the overall building project.

HVAC Integration and Space Optimization

The fifth aspect emphasizes the utility holes present in both the joists and blocking plates, which are strategically designed to accommodate not just HVAC systems but also other utilities, ensuring the efficient use of space and contributing additional support to the structure. The maximization of the utility of the slab space by integrating HVAC piping as an element of structural support is inherently linked to the first aspect of the invention. The HVAC piping, running through the utility holes in the joists and blocking plates and welded, riveted, or screwed to the joists, adds rigidity and facilitates air circulation with transverse and vent pipes, all made from cold-formed steel to match the joists' design perfectly.

In summary, the incorporation of these innovative technologies significantly refines the use and installation of composite slabs, delivering comprehensive benefits. The unique design and manufacturing methodology result in marked reductions in labor and material expenses. The structure's performance, durability, and efficiency are elevated through this novel design and the implementation of direct concrete casting and strategic HVAC integration. The design contributes to a reduction in overall slab weight, accelerates construction timelines, and enhances the building's resistance to environmental challenges. Thus, this invention represents a significant step forward in the field of building construction materials and methods.

FIG. 1 illustrates an isometric overview of a cold-formed-steel and wire-mesh-reinforced concrete composite slab of the present disclosure. 100 represents the entire composite slab system viewed from the bottom (represented by a bottom arrow of the viewing direction), showing the arrangement of all components under a concrete topping 114. The concrete board 114 covers the top side of slab 100 (represented by a top arrow of the viewing direction). The composite slab 100 is comprised of a plurality of cold-formed steel (CFS) joists 102 arranged in a parallel configuration, serving as the structural foundation of the slab. Each CFS joist 102 has a bottom flange 103 but does not have a counter-part top flange; instead, it has a special structure 110, which will be elaborated on a little later. The joist 102 is characterized by its lightweight, high-strength properties, fabricated into specific shapes to optimize load-bearing capacity and facilitate ease of installation.

Overlaying the CFS joists 102 is a Wire-Mesh-Reinforced concrete board layer 114, which encompasses the steel members and provides a durable, high-strength surface suitable for various applications, such as flooring in residential, commercial, or industrial buildings. The concrete board 114 is enhanced with wire mesh, which may be made from materials such as steel, fiberglass, or synthetic polymers, to improve the concrete's tensile strength, crack resistance, and overall durability. The concrete board 114 is further embedded and enhanced with wire mesh 112.

In the depicted embodiment, joist 102 represents the outermost joist, while 106 represents the other inner joists.

All joists are lined up parallel to one another. These components are constructed using cold-formed steel and feature a bottom flange 103, notably omitting the traditional top flange. Instead, the joists are designed with slots punched at their top side, resembling "fingers", which serve as connectors 110. The top edge is then outfitted with a series of these "fingers" connectors 110. These fingers 110 are designed to be cast seamlessly with the concrete layer, thus providing enhanced stability, durability, and integration for the slab 100. The joists 102, 106, and rim joist 108 are linked and securely welded to form the slab's main frame, and blocking plates 120 are interspersed perpendicularly between each of the two adjacent joists to furnish additional support and reinforce the structural rigidity of the assembly. They help to distribute the loads placed on the floor and minimize the movement of individual joists. Additionally, blocking can enhance the performance of floor finishes by minimizing deflection and reducing the risk of cracks or unevenness. The track joists/rim joists 108 and blocking plates 120 act as lateral bracing, preventing the joists from twisting or rotating under loads. This arrangement creates the waffle structure or waffle supporting system. The blocking plates can be considered secondary structural support in the waffle structure under the following conditions: 1) The number of blocking plates must have sufficient density. 2) The blocking plates must be reliably connected to the flange beneath the joists, for instance, through welding or by using a full-length U-330 shaped steel for reinforcement. Only when both conditions are satisfied, and the blocking plates approximate the strength of the supporting joists, can then be called forming the waffle supporting system.

In the present disclosure, the blocking plates between joists are all connected to the wire-mesh-reinforced concrete board through their top finger connectors. Therefore, both the top and bottom of the blocking plates are linked together. More specifically, each of the blocking plates connects to at least one other blocking plate at the top and/or bottom. Plus, the joists are also connected to the same wire-mesh-reinforced concrete board, so the waffle supporting system in the present invention will be much stronger than all the prior art.

Here are several additional points related to the waffle supporting system: 1. Waffle Structure: A waffle structure, also known as a grid structure, is characterized by a repetitive pattern of intersecting beams or ribs. These intersecting elements create a grid-like framework that distributes loads efficiently. Waffle structures are commonly used in engineering and architecture to achieve strength, stability, and load-bearing capacity. The term "waffle" refers to the resemblance of the grid pattern to the familiar breakfast treat. 2. Application to Building Systems: When we apply this concept to building construction, we find similarities in how certain components work together. Let's break down how the denser blocking structure and joists create a two-directional supporting frame akin to a waffle structure: 3. Denser Blocking Structure: In framing systems (such as wood or steel), blocking refers to horizontal or diagonal members placed between joists, studs, or rafters. The purpose of blocking is to: Stabilize the framing system. Prevent twisting or warping. Enhance load distribution. By adding more blocking, we increase the density of the grid within the framing system. 4. Joists: Joists are horizontal structural members that support the floor or ceiling loads. In traditional wood framing, floor joists run parallel to each other. However, when we introduce additional blocking (such as cross-blocking or diagonal blocking), we create a more interconnected system. This denser arrangement resembles the waffle structure, with intersecting elements providing mutual support. 5. Two-Directional Support: The denser blocking structure, combined with joists, creates a robust framework that supports loads in two directions: Longitudinal Direction: The joists primarily bear the load along their length (spanning from one end to the other). Transverse Direction: The blocking provides lateral support, preventing joists from twisting or sagging. Together, they form a waffle-like grid that efficiently distributes loads in two directions. 6. Benefits: The waffle-like arrangement enhances structural integrity, especially in floors and ceilings. It minimizes deflection, improves load-carrying capacity, and reduces the risk of uneven settling. The interconnected nature of the system ensures stability and resilience.

The connectors 110 are employed to securely attach the CFS joists (102, 106) to the concrete board layer 114, ensuring a robust composite action between the steel and concrete materials. These connectors are typically designed in various types to provide structural support and transfer loads between the concrete and joists. They help ensure that the joists are securely attached to the concrete structure, preventing detachment or separation. By establishing a strong connection, the connectors enhance the overall stability of the floor or building structure. This design has punched connectors on both joists and blocking plates.

Additionally, FIG. 1 shows special track joists/rim joists 108, which also serve as slab edge reinforcements, which are applied along the perimeter of the slab perpendicular to the joists 102 and 106 to enhance its edge strength and prevent spalling of the concrete. The rim joists 108 are typically located at the ends of your floor joists. The rim joists provide lateral support to the floor joists. The rim joists and end joists/outermost joists form the boundary of the floor framing system. They also are called band joists. The rim joists evenly distribute loads across the structure. A blocking plate 120 is placed between floor joists. (1) It provides lateral stability to the floor joists, preventing them from shifting or "rolling over" due to lateral loads. (2) Blocking evenly distributes the loads placed on the floor joists. (3) It compensates for any twisting or warping in the joist boards. (4) Blocking minimizes floor wobble and bounce.

Among the joists 102 and 106, track joists/rim joists 108, and blocking plates 120, there are utility conduits 116, which may be embedded within the slab through joists' holes 104 and blocking plates' holes 122 are also depicted, illustrating the slab's capability to integrate services such as electrical wiring and plumbing within its structure.

Resilient strips 118 are affixed, either by clipping, welding, riveting, or screwing, onto the lower flanges 103 of the joists 102 located at the base of the slab 100, in alignment with the direction of the track joists/rim joists 108 and blocking plates 120. These resilient strips are designed to attenuate noise transmission, and their strategic positioning between the joists enhances acoustic performance markedly.

The detailed arrangement of the CFS joists 102, coupled with the strategic incorporation of wire mesh in the concrete board layer 114, exemplifies the innovative design of the composite slab 100. This configuration not only leverages the beneficial properties of both cold-formed steel and Wire-Mesh-Reinforced concrete but also addresses common challenges in construction, such as the need for materials that are both lightweight and capable of bearing significant loads.

The composite slab 100 is designed to be manufactured and installed efficiently, offering a practical solution for rapid construction projects while maintaining high standards of safety and performance. The detailed description of FIG. 1 underscores the inventive aspects of the cold-formed steel and Wire-Mesh-Reinforced concrete composite slab, highlighting its potential to revolutionize building practices with a focus on sustainability, durability, and structural efficiency.

This generic description is based on common elements found in cold-formed steel and Wire-Mesh-Reinforced concrete composite slabs and is intended to serve as an example of how to describe a figure in a patent specification. The specific details of FIG. 1 in the present disclosure may vary, and it would be important to tailor the description to accurately reflect the unique aspects of the present invention.

Figure 2:
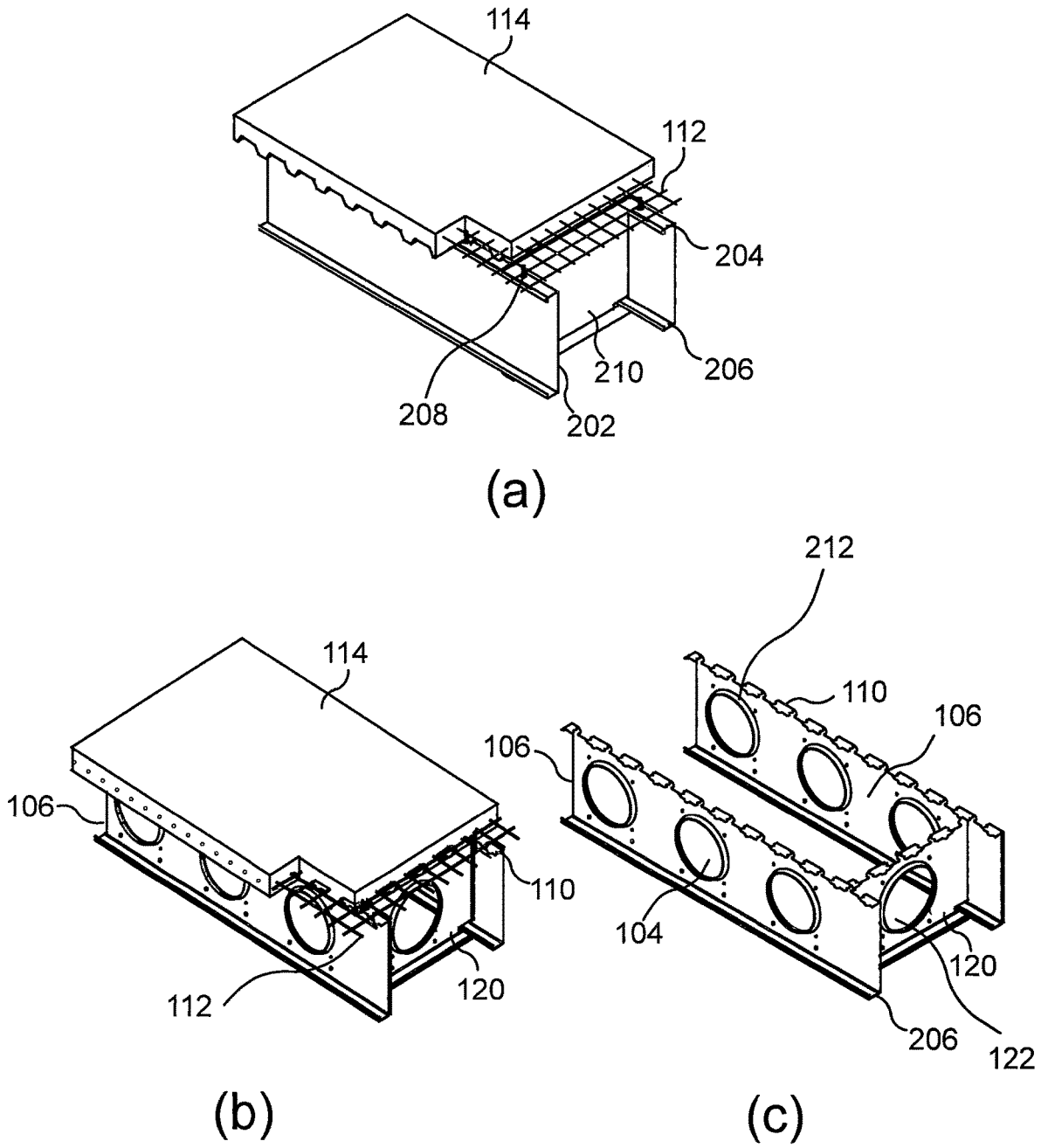
FIG. 2 depicts the process of direct concrete casting as applied to both prior art and the preferred embodiments of the composite slab.

FIG. 2 illustrates a comparison in three isometric and cross-sectional views and details of a segment of cold-formed steel and Wire-Mesh-Reinforced concrete composite slab, which is part of a floor system or wall system designed for building construction. Sub-figure (a), i.e., FIG. 2(*a*) depicts a partial cross-sectional view of a traditional composite slab in at least one of the prior arts. It includes 202: A cold-formed steel (CFS) joist, acting as a structural base for concrete adhesion; 210: A blocking plate, which lateral supports installed between joists to evenly distribute loads placed atop floor joists. as shown; The blocking plate and the concrete board do not have a direct connection; 114: Concrete top board, which is a Wire-Mesh-Reinforced 112 layer providing the main compression surface of the slab. It has a corrugated steel deck below to be connected to the joists and blocking plates. The top flange 204 of joist 202 is attached to the concrete top board, ensuring that the steel and concrete act together structurally; 208: Top shear connectors of both the joist 202 and blocking plates 210 anchor the joists and blocking plates to the concrete board, ensuring that the steel and concrete act together structurally; 206: Bottom flange of the joist 202; 112: Top reinforcement wired mesh, providing additional tensile strength to the concrete topping.

The connectors between the concrete board and the joists may lack strength and are at risk of breaking under shearing force. Additionally; the use of corrugated steel as a mold for the cast-in-situ concrete board incurs additional costs. Furthermore, there is no direct connection between the blocking plate and the concrete board. So, it is not as strong as the joists; this structure mostly serves as one-directional support only.

FIG. 2(*b*) and FIG. 2(*c*) represents a cross-sectional view of one of the embodiments of the newly invented slab in the current disclosure, showing the comparison over the prior art illustrated in sub-figure (a). FIG. 2(*b*) and FIG. 2(*c*) tries to illustrate the interaction between the CFS members (102, 106, 108, 120, 110) and the concrete board layer (114). FIG. 2(*b*) represents the same slab segment of FIG. 2(*a*) of the current disclosure with all the similar layers and components. FIG. 2(*c*) illustrates the same segment piece of the new slab in FIG. 2(*b*) with the top concrete board layer 114 removed. Without the top concrete board layer 114 and its embedded wire mesh 112, the new inner joist 106 and blocking plates 120 are fully revealed. Now, the utility holes 104 in the joist and utility holes 122 in the blocking plates can be visible.

The flare or lip around the utility holes in a joist's web serves several important functions in construction and structural design: Enhanced Strength and Load Distribution: The flare or lip reinforces the area around the utility hole, preventing stress concentrations. By distributing loads more evenly, it helps maintain the overall strength of the joist. Without the flare, the sharp edges of the hole could weaken the joist web and potentially lead to failure. 2. Reduced Risk of Cracking or Fracture: When a utility hole is cut into the joist web, it creates a vulnerable point. The flare or lip acts as a buffer, reducing the risk of cracks or fractures originating from the hole. It provides additional material to resist bending forces and shear stresses. 3. Improved Stiffness and Rigidity: The flare increases the stiffness of the joist web around the hole. This stiffness helps maintain the joist's shape and prevents excessive deflection. It contributes to the overall stability of the floor or roof system. 4. Guidance for Installation: The flare provides a visual guide for installers when positioning services (such as pipes or cables) through the hole. It ensures that services are correctly aligned and centered within the utility hole. 5. Mitigation of Stress Concentrations: Without the flare, stress concentrations could occur at the sharp edges of the hole. These stress concentrations might lead to premature failure or reduced load-carrying capacity. The flare helps distribute stresses more uniformly, minimizing localized weaknesses.

However, the major innovation of the new design is the introduction of finger connectors, labeled as 110. Unlike the traditional design that featured top flanges and anchors numbered 204 and 208, the updated design replaces these with finger connectors. These connectors come in a variety of shapes and offer different characteristics, marking a significant departure from the old design, which lacked these features.

Also, FIG. 2(*b*) combines all the elements from the previous paragraphs to show a composite assembly, including 106: one of the inner joists. 120: blocking plates were installed perpendicularly to the joists to form a stronger structure. 110: Shear connectors, which are typically welded or otherwise secured to the wire mesh and embedded into the concrete topping. Also serve as indentations or embossments on the surface of the CFS decking, which increase the surface area and the mechanical bond with the concrete; 104 and 122: Utility holes or placeholders for services integrated into the CFS decking to provide facilities for electrical, plumbing, or HVAC systems within the slab. 114: The concrete board.

The numbers from FIG. 2(*a*), FIG. 2(*b*), and FIG. 2(*c*) are repeated here to demonstrate the relationship between the CFS decking, the shear connectors, and the placement of the concrete topping.

In combination, FIG. 2 provides a comprehensive understanding of the key improvements or innovations of the current disclosure over the prior arts and the relationship of individual components and their arrangement within the Cold-Formed Steel and Wire-Mesh-Reinforced Concrete Composite Slab. The views highlight the interconnectivity and function of each part in contributing to the overall structural performance of the slab.

Figure 3:
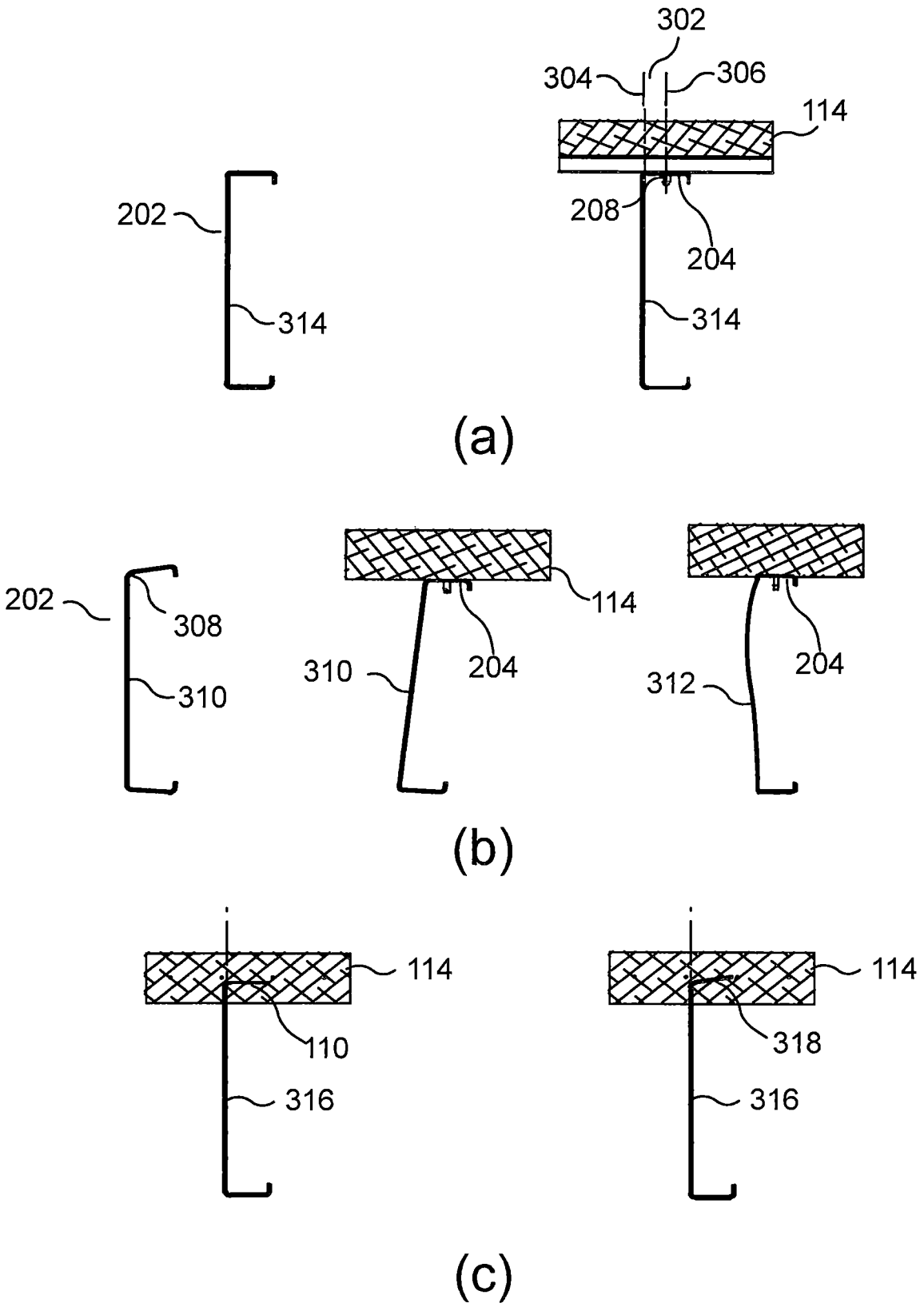
FIG. 3 offers side views comparing the prior art and preferred embodiments of a joist in states before and subsequent to concrete casting.

FIG. 3 illustrates cross-sectional views detailing the interconnection of a joist and a concrete board in a Cold-Formed Steel and Wire-Mesh-Reinforced Concrete Composite Slab of the current disclosure and the solutions of the prior art. It illustrates the problems the prior-art designs have, compares the current disclosure to the prior-arts, and explains why replacing the top flanges with "finger" connectors in both joists and blocking plates is beneficial over all the prior-arts.

FIG. 3(*a*) illustrates a cross-sectional view of an existing joist 202 and a concrete board 114 in a prior-art solution. The C-shaped cross-section of the joist 202 is shown on the left. The center/middle part of joist 202, namely joist web 314, should be normally vertically straight. The design of the C-shaped joist 202 is responsible for bearing the load over it. The joist web has a flange of 204 at the top and a flange at the bottom. The top flange 204 interacting with a concrete board 114 is illustrated on the right side. The top flange 204 is anchored to the concrete board with a right angle to the joist web 314 by a shear connector. The anchor is not aligned with the center plane of the load; it indeed introduces an offset 302 between the center of the anchor 306 and the plane 304 of the joist web 314. This offset can create an unbalanced load distribution, potentially affecting the mechanical strength and stability of the connection. Lever Arm Effect: The offset creates a lever arm (distance from the center plane to the point of application). The longer the lever arm, the greater the moment (torque) applied to the anchor. Shear Forces: the offset can impact the shear strength of the structure. In shear, the offset increases the bending moment, potentially leading to failure. Tensile Forces: the offset can impact the tensile strength of the structure. In tension, the offset affects the axial load distribution. In other words, the weight of a thick concrete board 114 falls on location 306, while the joist 202 support point is at plane 304. Because this offset 302 serves an arm in a level mechanism, the concrete board 114 may easily bend the top flange 204 around the joist web 314. This poses a general problem for all the existing products and solutions.

As the Joist 202 typically undergoes two different forces. The top flange 204 of the joist 202 is typically subject to compressive forces, which means it is being pushed together or compressed. This is because the top flange 204 is subjected to loads or weight from the structure or material above it. On the other hand, the bottom flange 206 of the joist 202 experiences stress forces. Stress forces occur when a material is pulled or stretched, and in the case of the bottom flange 206, it is stretched due to the loads or weight it carries. The bottom flange 206 is responsible for bearing the tension and resisting the forces that try to elongate or pull it apart. By having a structural design where the top flange 204 carries compressive forces and the bottom flange 206 bears tensile forces, the 202 joists can effectively distribute the load and provide the necessary support for the structure it is a part of.

FIG. 3(*b*) shows the various situations when the angle 308 between the top flange and the web is not 90 degrees. In the first example of FIG. 3(*b*), the angle 308 is greater than 90 degrees. This is also called insufficient bending. The relationship between the joist web 310 and the concrete board 114 will be like the middle sub-figure of FIG. 3(*b*). The web 310 will become tilted due to the angle 308 being greater than 90 degrees if it is assumed the bottom flange is not constrained. If the bottom flange position is limited by bridging or other positioning devices, the situation will become the right sub-figure of FIG. 3(*b*). In this case, the joist web becomes curly bent 312, and the stress remains in the joist web 312. Both tilting and curly bent can greatly reduce the maximum support capacity of the joist. Only the joist web standing straight vertically (90-degree case) can support the heaviest weight from the concrete board 114 due to the stress being passed down to the bottom flange by the joist web. If a joist is not at a right angle to the floor panel (meaning it is tilted or skewed), it can significantly impact its strength and load-carrying capacity. Let's explore why: 1. Load Distribution: Joists are designed to carry loads (such as the weight of floors, walls, and occupants) from above. When a joist is tilted, the load distribution becomes uneven. The load may not transfer directly along the joist's intended axis, leading to localized stress concentrations. 2. Bending and Shear Stresses: Joists primarily resist bending and shear stresses. When a joist is not perpendicular to the floor panel, it experiences bending moments that it wasn't designed for. The skewed orientation introduces additional bending forces, potentially causing deflection or failure. 3. Reduced Effective Depth: The effective depth of a joist is the distance from the top flange to the neutral axis (where bending stresses are zero). When a joist is tilted, its effective depth decreases. A smaller effective depth means reduced resistance to bending stresses. 4. Shear Capacity: Shear capacity is critical for joists. A tilted joist experiences shear forces along its length. The shear . . . capacity decreases when the joist is not aligned properly. 5. Deflection and Sagging: A tilted joist is more prone to deflection (excessive bending) and sagging. Floors may become uneven, affecting the building's functionality and aesthetics.

Similar situations happen when the angle 308 is less than 90 degrees. The reason for the angle 308 not keeping straight 90 degrees is mainly due to the offset 302 between the weight load gravity center 306 and the supporting point 304. The longer the offset 302, the easier it is for the bending to occur. However, during manufacturing in a factory, 308 is not a right angle because insufficient bending or overbending may occur during a factory bending process, which is unrelated to offset 302.

FIG. 3(*c*) illustrates a cross-sectional view of a novel joist 102 of the present disclosure. A similar C-shaped cross-section of the joist 102 is shown on the left. The center part of joist 102, namely joist web 316, can now always be straight. Instead of a top flange 204, the joist 102 has a finger-shaped connector 110 at the top and a flange at the bottom. The bottom flange is the same as that in a prior art. The new top connector interacting with a concrete board 114 is illustrated in FIG. 3(*c*). The concrete board 114 can be a floorboard, a ceiling board, or a wall of a building. The top connector is sometimes also called a finger connector or simply a finger because it looks like a finger. In the present disclosure, the punched connectors 110 are cast directly in the concrete board 114. The finger connectors 110 become part of the concrete board 114, so the whole joist 102 is also part of the concrete board 114. When the concrete holds the web straight, and the connectors and the joist web are aligned at the same center plane with no offset, the CFS joists experience reduced susceptibility to local bucking when a thick concrete board is used to transfer loads evenly to the joist.

The next sub-figure of FIG. 3(*c*) illustrates the situation that the fingers 318 have insufficient bending; therefore, angle 308 is greater than 90 degrees. Because the punched fingers 110 are cast in the concrete board 114 completely, the joist web 206 can remain perfectly perpendicular to the concrete board 114 even though the finger connector 318 is not perfectly perpendicular to the joist web 206. Once the finger connectors 110 are cast in the concrete, even if the angle of bending the finger is slightly deviated, the bond strength between the concrete and the finger remains unchanged. The joist with imperfect connectors can be installed perfectly during concrete casting.

The punched finger connectors are embedded or cast into the concrete. They become an integral part of the concrete slab. Because the connectors are aligned with the web, there is no stress remaining in the joist web after casting. The roots of these connectors are at the same plane as the joist web. This means that the connectors and the web are perfectly aligned without any offset. The joist web is perpendicular to the concrete panel; even the connectors are not bent at a perfectly right angle. This alignment ensures that the joist efficiently transfers loads to the concrete, maximizing the overall structural strength. The stress is evenly distributed across the joist and the concrete, enhancing load-bearing capacity.

These sub-figures in FIG. 3 collectively illustrate the design considerations for combining steel joist profiles with a concrete board layer to form a composite slab. The figures demonstrate how different imperfections of the joists can be corrected and unified to form a structurally sound and functional flooring system capable of integrating building utilities while maintaining the necessary strength and integrity.

Figure 4:
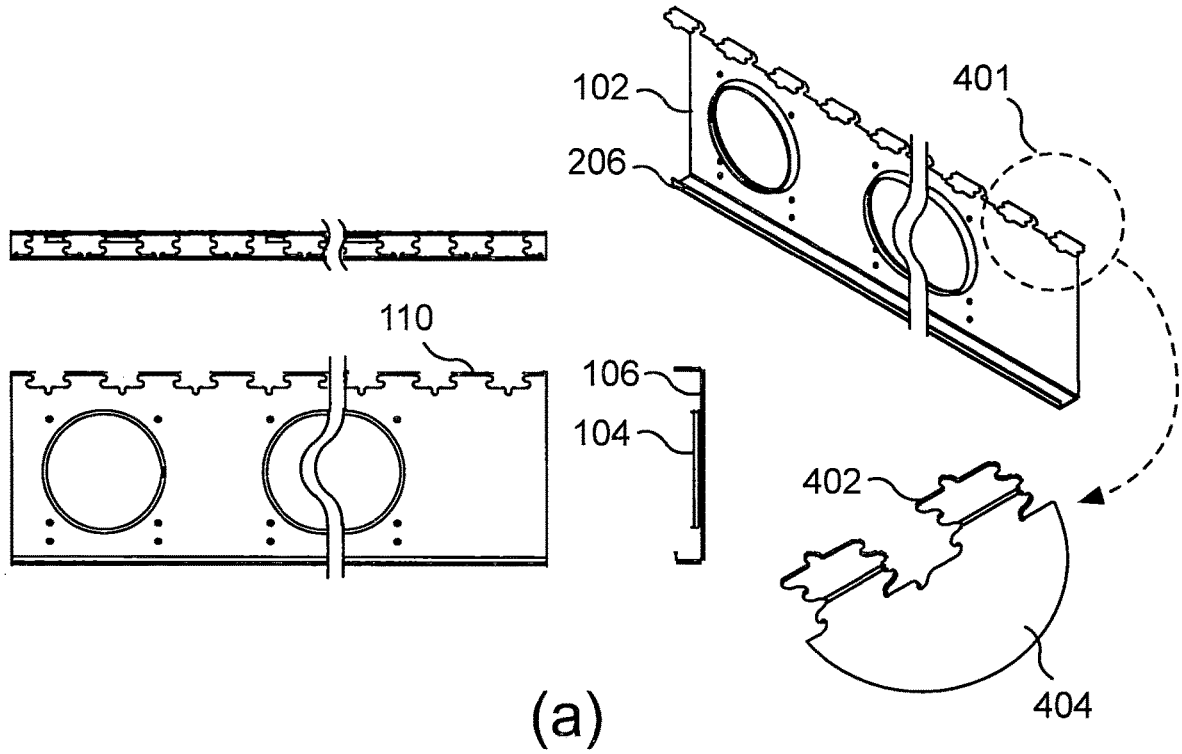
FIG. 4 showcases various perspectives, including front, side, top, and detailed views of a modified joist according to both the preferred and alternative embodiments of this invention.
Figure 4:
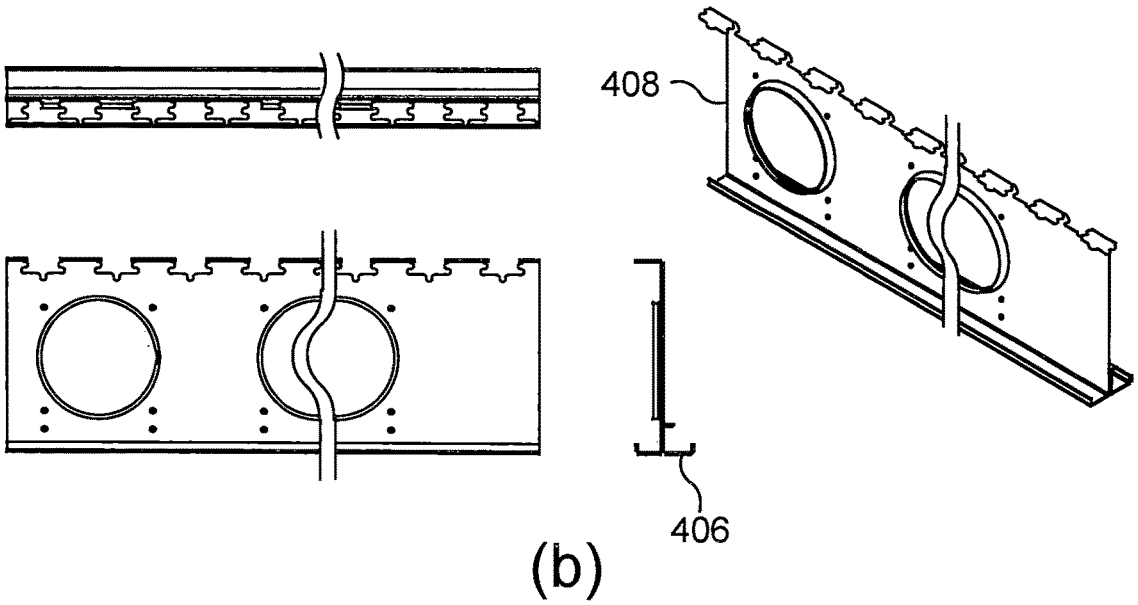

FIG. 4 illustrates the finger connector engagement mechanisms and adjustability features of the cold-formed steel (CFS) component of a composite slab. This figure uses a wave edge finger connector as an example to demonstrate the engagement mechanism. The other various types of edge finger connectors will be further elaborated and demonstrated in the next figure:

Generally, the design of the direct cast-in top connectors offers the following advantages: (1) Enhanced Mesh Placement: The connectors feature an entire flat top surface that provides improved support for laying the steel mesh onto them, ensuring better integration and stability of the mesh. (2) Simultaneous Dual Joist Production: Compared to the prior-art solutions, the new design allows for the simultaneous production of two joists with a fixed offset between them. This increases efficiency and reduces manufacturing time. (3) Optimized Material Usage: In the simultaneous two joists production, the two joists are placed head-to-head, and each is equipped with evenly slotted same number of connectors, which are split using a shearing process. So, the material between two connectors in one joist is used as connectors in the other joist. This results in great material savings. (4) Strong horizontal connection: When the top connectors are cast into the concrete, they become securely "locked" in place due to the top connection. This type of design offers a superior connection to the concrete. The advantage of using connected top connectors for the edge joist of the slab is that there is no need for a welding process to attach the wire mesh, simplifying the manufacturing process. The wave edge of the connector design ensures the end joists/rim joists and the concrete bond well so the connector won't slide out.

FIG. 4(*a*) illustrates a perspective view, a top view, a front view, and a side view of such a new open-top finger-connector 110 joist 102 with a single bottom flange 206. Each joist 102 has a number of utility holes 104. The whole joist 102 can be manufactured from a single piece of steel sheet material by a shearing process. The top connectors are then bent by ninety degrees to form fingers 110. In section 401, an amplified illustration shows the details of the top finger area, as 402 is the bent finger and 404 is the joist web part. In FIG. 4(*a*), finger 402 is shown as a wave edge finger as an example. These fingers 402 are designed to increase the bonding area with the concrete topping. The wave edge finger offers a superior connection to the concrete compared to straight edge connectors. The advantage of using waved edge connectors for the end and rim/joist of the slab is that there is no need for a welding process to attach the wired mesh, simplifying the manufacturing process. The wave finger connectors can secure the wired mesh. The bottom flange 206 is formed by the rolling-form process or by bending twice with a press brake to form a C-shaped flange at the bottom. The joist hole 104 also represents the side profile of the utility hole in the joist 102. This profile is the result of the punching and flaring process, and its flare edge is on the same side as the bottom flange and the finger connectors.

Different from FIG. 4(*a*) that illustrates the joist with a single bottom flange, FIG. 4(*b*) illustrates a similar CFS-CS joist 408 with a double bottom flange 406 of the present disclosure. The top view and the side view show a second bottom flange on the other side of the FIG. 4(*a*) single bottom flange 206. From the side view, the double bottom flange 406 and the joist 408 look like an upside-down letter "T". Other than the difference of the bottom flanges, all other parts of the joists in FIG. 4(*a*) and FIG. 4(*b*) are exactly the same. The double bottom-flange joist consists of two components: a C-shaped joist and a lipped steel angle. These two pieces are attached to create a symmetrical bottom flange. The connection between the steel angle and the C joist can be achieved through screwing, riveting, or welding methods. This design serves as an alternative to using two C-section joists placed back-to-back. By Combining the C-joist with the lipped steel angle, material usage is optimized. The web and top section of the joist require less material since the primary function of this joist is responsible for bearing the tension force at the bottom, while the top section of the slab is made of concrete, which provides compression force. As a result, the top and middle sections of this steel joist are of lesser importance in terms of structural performance. The double bottom-flange design is a preferred embodiment of the present disclosure.

The blocking plate 120, similar to the joist, also incorporates connectors at its top. These connectors are cast into the concrete, ensuring a strong bond with the concrete panel. The connectors serve an important purpose in the blocking plate by facilitating a strong connection between the concrete board and the blocking plate. This connection enables the slab to distribute the load placed atop floor joists evenly. When the blocking plates are placed in a denser pattern, the floor slabs form a bi-directional bracing system or waffle structure, with one direction being provided by the joists and the other by the blocking plates. By utilizing the connector in this manner, the overall structural integrity of the slab is enhanced. The bi-directional bracing system or waffle structure will be further illustrated and explained in detail in FIG. 7 and FIG. 8. The bottom flange of the blocking plate securely attaches to the flanges of the joist using welding, riveting, or screwing methods.

Figure 5:
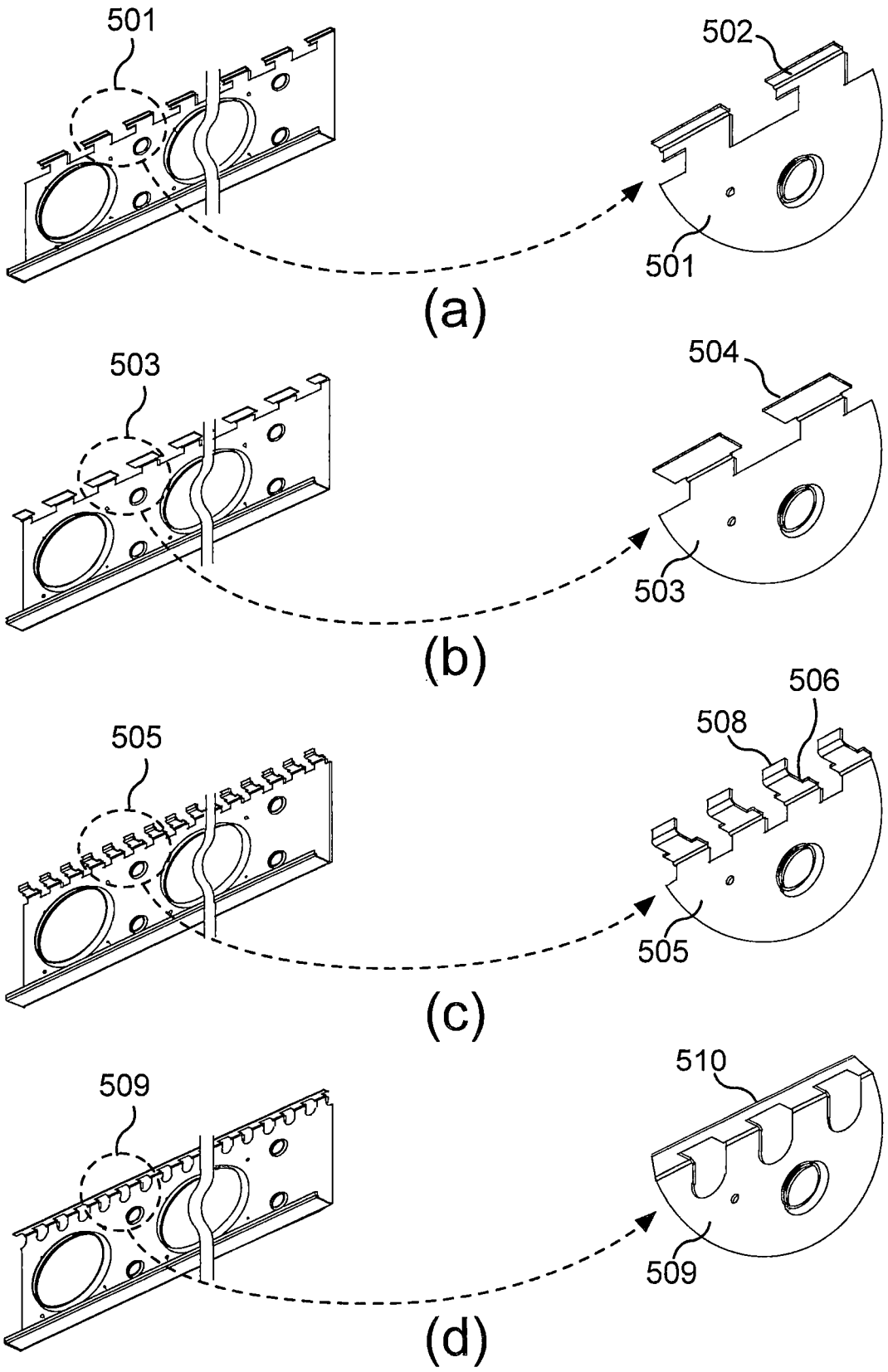
FIG. 5 provides perspective and detailed views, specifically focusing on alternative embodiments of a modified joist's connectors within this invention.

FIG. 5 displays variants of the finger connectors of the present disclosure and their shapes and placement on the cold-formed steel (CFS) section for a composite slab. Even though the present disclosure provides exemplary finger designs in FIG. 4 and FIG. 5 to an ordinarily skilled in the art, other similar designs not illustrated or described in the present disclosure should also be implied herein.

FIG. 5(*a*) illustrates one of the finger connectors in this disclosure. This variant is a design of the cast-in flip "L" shaped connector (or "7" shaped connector). 501 represents a section of the fingers to be amplified and shown on the right side of the figure. The amplified drawing shows two "L"-shaped fingers 502. It does not only look like an "L" from the side view, which is along the joist length direction but also looks like a flipped "L" from the front view and back view, which is facing the utility holes direction. The main advantages of this design and shape are that it is easy to manufacture, less waste of steel material, and still having a very good splicing with the wire meshes and concrete at the same time.

FIG. 5(*b*) illustrates one of the finger connectors in this disclosure. This variant is a design of the cast-in "T" shaped connector. 503 represents a section of the fingers to be amplified and shown on the right side of the figure. The amplified drawing shows two "T"-shaped fingers 504. It looks like a letter of "L" from the side view, which is along the joist length direction, but it looks like a "T" from the front view or back view, which is facing the utility hole's direction. The main advantages of this design and shape are that it is easy to manufacture, less waste of steel material, and has an even better splicing with the wire meshes and concrete.

FIG. 5(*c*) illustrates one of the finger connectors in this disclosure. This variant is a design of the cast-in flip "T" shaped connector. 505 represents a section of the fingers to be amplified and shown on the right side of the figure. The amplified drawing shows four flip "T"-shaped fingers 508. It looks like a flipped letter "Z" from the side view, which is along the joist length direction, but it looks like a flipped "T" 506 from the top view, which is facing the wire mesh's direction. But it looks like simply slotted teeth from the front view or back view, which is facing the utility hole's direction. The main advantage of this design and shape is that it has less waste of steel material and excellent bonding with wire meshes and concrete. It is a little more complicated but still simpler to manufacture compared to the prior arts. When the flip "T" shaped connectors are cast into the concrete, they become securely "locked" in place due to the additional lip. This type of lipped design offers a superior connection to the concrete compared to flat-top connectors.

FIG. 5(*d*) depicts a particular embodiment of finger connectors detailed in the present specification. This embodiment is an adaptation of a pre-existing top flange design, modified to include a series of slotted connectors fashioned by incising slots into the joist and top flange (as indicated by the number 509 on the figure, which points to a detail that is enlarged on the figure's right side, showing three slotted connectors numbered 510). While the process of cutting does result in some material loss, the slots created serve to augment the anchorage with the wire mesh and the concrete cast directly therein. The primary benefits of this modified design and configuration include ease of production and improved integration with wire meshes.

Each pair of images in FIG. 5 demonstrates how different finger connector designs can be utilized to optimize the performance of the composite slab system, ensuring the structural integration of the CFS and concrete components. The detailed views are essential for understanding the mechanical interaction between the connectors and the concrete, which is-fundamental to the slab's overall strength and durability.

Figure 6:
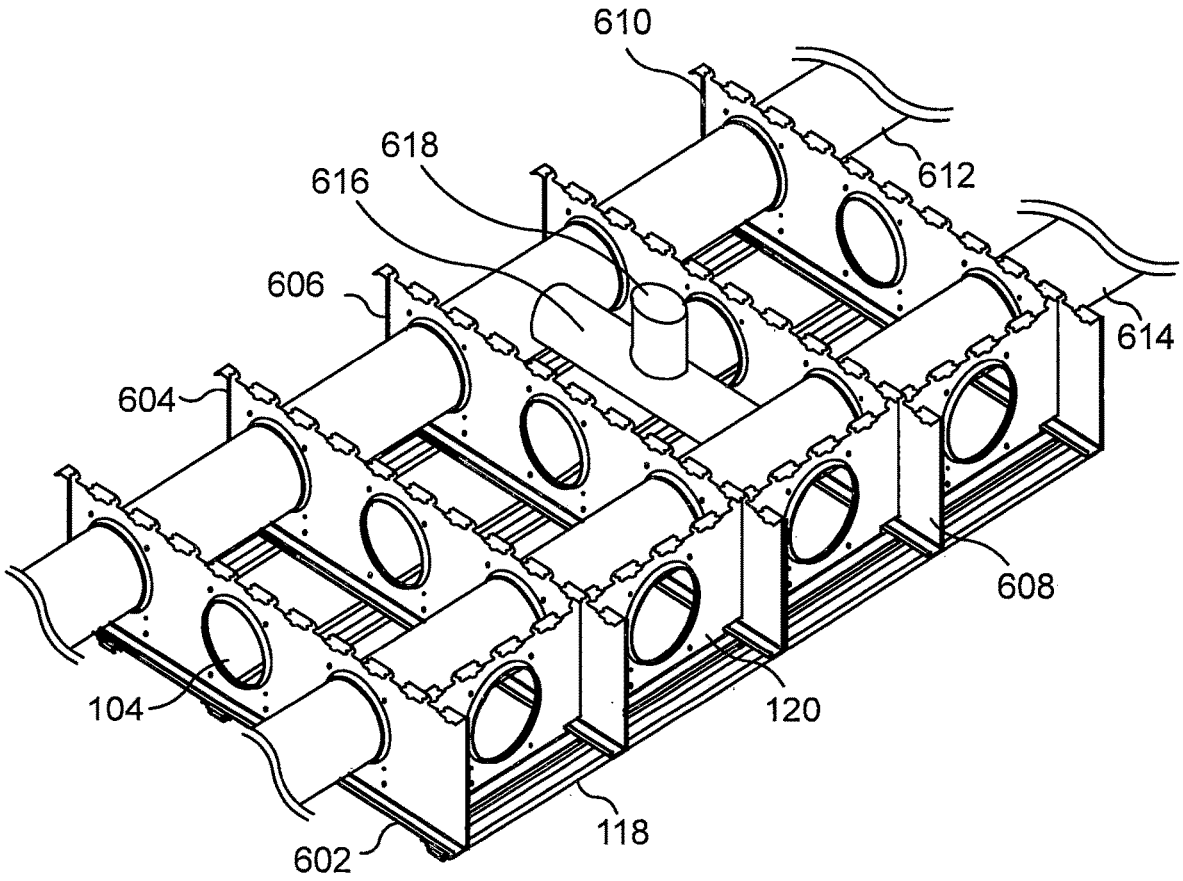
FIG. 6 exhibits a top perspective view detailing how the composite slab's joists/blocking plates integrate HVAC piping through designated utility holes.

FIG. 6 illustrates an isometric view of an assembly for a Cold-Formed Steel and Wire-Mesh-Reinforced Concrete Composite Slab detailing how the composite slab's joists/blocking plates integrate HVAC piping through designated utility holes. 612 and 614 are two latitude HVAC pipes. The latitude is defined as the direction along the track joists/rim joists 108 and blocking plates 120. 616 is a longitude HVAC pipe. The longitude is defined as the direction along the joists (602, 604, 606, 608, 610). This latitude HVAC pipe is T-connecting with both the longitude HVAC pipes 612 and 614. 618 is an HVAC T-shaped venting pipe stemming vertically from the longitude HVAC pipe 616 and playing a role in venting air. The new joists (602, 604, 606, 608, 610) and blocking plates 120 have many utility holes 104 and 122. The latitude HVAC pipes (612, 614) and longitude HVAC pipe 616 are installed through those utility holes (104, 122). Additional Resilient strips 118, or called resilient bars, can be attached to the joists with clips for damping sound waves and providing superior acoustic performance. The Resilient strip 118 is normally, but not limited to, installed latitudely along the blocking plate's direction, as shown in FIG. 6.

In traditional construction practices, HVAC piping is typically installed beneath cold-formed steel (CFS) slabs. However, the novel design of the Cold-Formed Steel and Wire-Mesh-Reinforced Concrete Composite Slab described herein allows for the incorporation of HVAC pipes within the slab itself. This integration significantly enhances space efficiency within the structure. Moreover, the assimilation of HVAC pipes and the provision of utility apertures/holes contribute to the structural integrity, reinforcing the joist's lateral support and optimizing the slab's strength.

Figure 7:
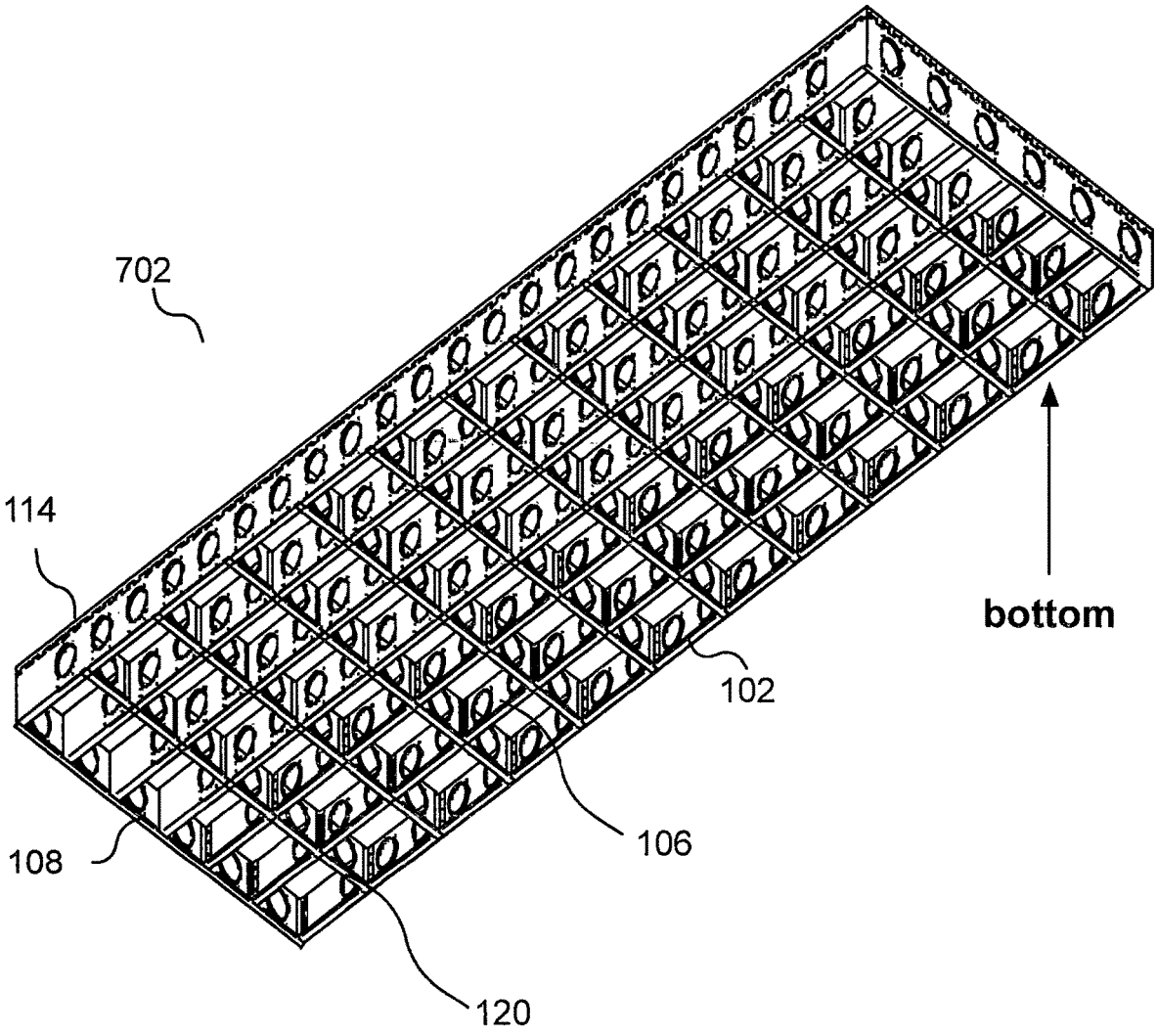
FIG. 7 presents a perspective of the waffle structure of a full slab utilizing the CFS-WMRC composite slab as described in this invention.

FIG. 7 depicts an isometric view from the bottom of the waffle structure of a full slab 702 utilizing the CFS-WMRC composite slab as described in this invention. This figure gives an overview of the CFS-WMRC reinforcement structure, joists (102, 106), track joists/rim joists 108 and blocking plates 120, crucial for the slab's strength and integrity, and illustrates the composite nature of the assembly by combining steel meshes and concrete materials 114. There are finger-shaped connectors, replacing the traditional top flanges at the top of both the joists 102, track joists/rim joists 108, and blocking plates 120, which are directly cased into the top concrete board 114 together with a steel wire mesh. The finger connectors securely bond the mesh and concrete with the joists and blocking plates, as well as the integrated HVAC pipes threaded through apertures in all directions, to form a modern CFS-WMRC composite slab with improved structural performance, reduced construction costs, and an environmentally resilient building component suitable for diverse architectural applications.

The exceptional bond between the blocking plate and the concrete enables the creation of a two-direction supporting system or waffle slabs. The joists serve as the primary direction, while the blockings act as the secondary direction perpendicular to the joists. This combined system enhances structural stability and load-bearing capacity. By incorporating the blocking system with its slotted finger connectors and secure attachment to the concrete, a robust and versatile construction solution is achieved, providing reliable support in multiple directions.

Figure 8:
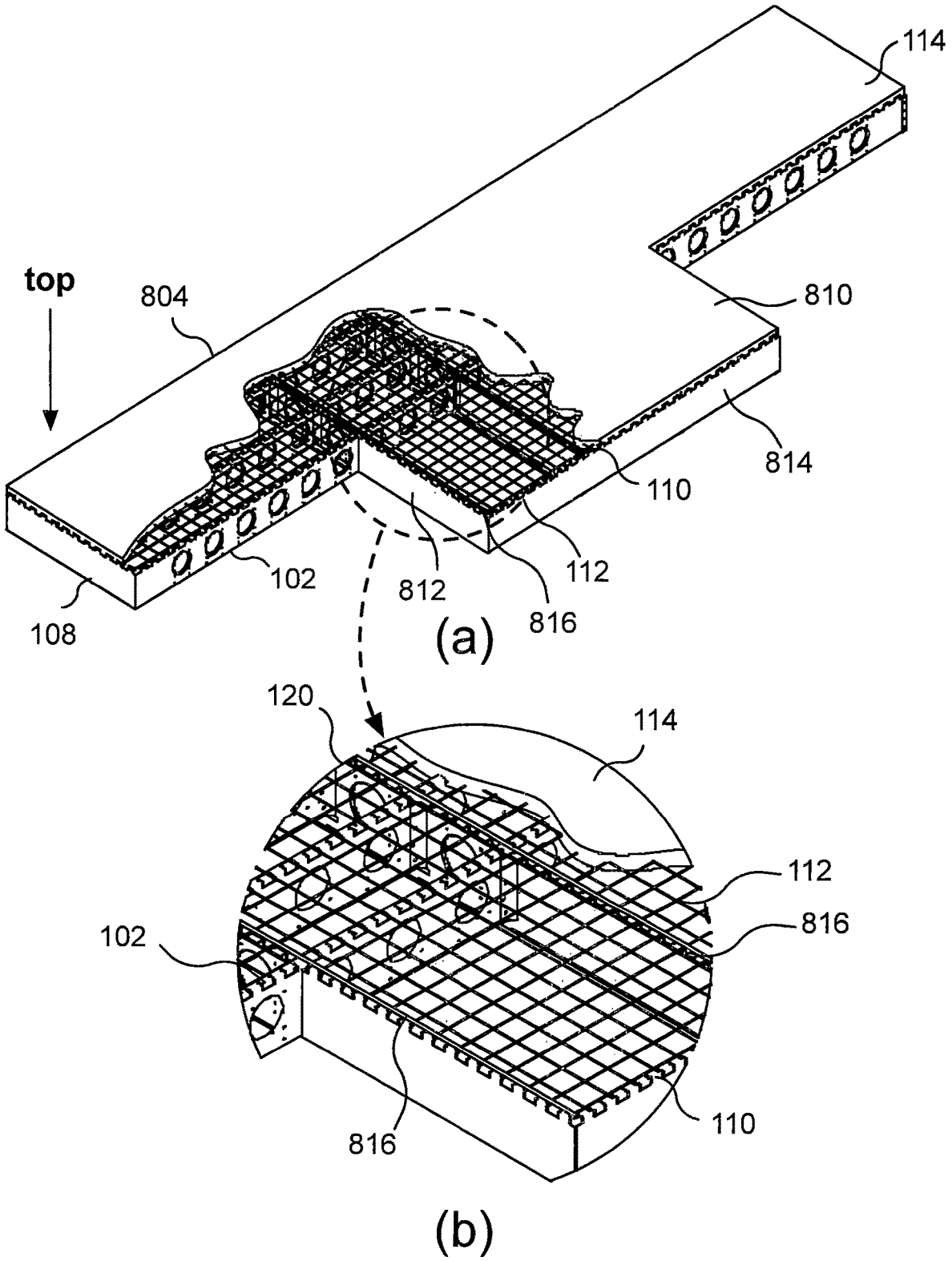
FIG. 8 presents perspective and detailed views of a waffle slab and balcony deck construction utilizing the CFS-WMRC composite slab as described in this invention.

FIG. 8 provides an exploded isometric view from the top of the Cold-Formed Steel and Wire-Mesh-Reinforced Concrete Composite Slab with a balcony deck, further illustrating the assembly and layering of components, as well as a detailed view of a waffle balcony deck construction utilizing the CFS-WMRC composite slab as described in this invention.

In FIG. 8(*a*) exploded view of a full slab 804 with a balcony deck 810, partial of top concrete board 114 of the main slab, and the balcony deck peeled off to demonstrate the underneath slab structure. The steel wire mesh 112 is now visible. The mesh is embedded inside the top concrete board 114. The meshed concrete board 114 is directly case onto the joists 102, balcony joists 812, rim joists 108, balcony rim joist 814, and blocking plates 120. The top of the joists 102, balcony joists 812, rim joists 108, balcony rim joists 814, and blocking plates 120 are full of little finger-like connectors 110. The fingers are fully embedded inside the top concrete board 114 and securely bond the mesh and concrete board together. Full-length joists 102 support the whole main slab in a longitude direction. The blocking plates 120 and balcony joists 812 are aligned, and rebars 816 are placed on top of them thereof to increase tensile strength. The blocking plates 120, balcony joists 812, and rebars 816 are used to form the latitude direction support. Connector 110 plays a vital role in the design as it improves the integrity of the floor slab. Not only does it evenly distribute the loads above the floor slab, but it also helps to transfer tensile, compressive, and shear forces between the concrete slab 114 and the CFS frame.

This example showcases the utilization of a balcony where the wider indoor section consists of a full-length regular floor, while the narrower outdoor section functions as the balcony, resulting in a cantilevered system. The joist/concrete connector establishes a sturdy connection that allows the blocking plates to serve as an additional supporting element in a direction perpendicular to the floor joists. The aligned arrangement of the balcony joists 812 and the blocking plates 120 forms a second directional support system, latitudinal support, whereas the first support system is longitudinal support. It is worth emphasizing that reinforcing rebars 816 are strategically positioned along the blocking plates and balcony joists to enhance the tensile strength of the top section of the blocking plates and balcony joists.

FIG. 8(*b*) illustrates a close-up magnified view of a composite slab with a balcony deck of the dashed circler area in FIG. 8(*a*). Balcony joist 812 interlocks with slab joists 102 and blocking plates 120 with many finger connectors 110 at their top. The finger connectors 110 safely lock the wire mesh 112 with the entire joists (102, 108, 812, 814) and blocking plates 120 inside the concrete board 114. From FIG. 8(*b*), one can see there are no blocking plates in the balcony area 810.

Overall, FIG. 8 showcases one of the example embodiments of the possible CFS-WMRC balcony deck design, providing insight into the slab's structural design and the mechanisms that contribute to its strength and stability. This is not to limit the embodiments in the eyes of those skilled in the art to recognize other related concepts that may be practiced without these specified conditions.

Figure 9:
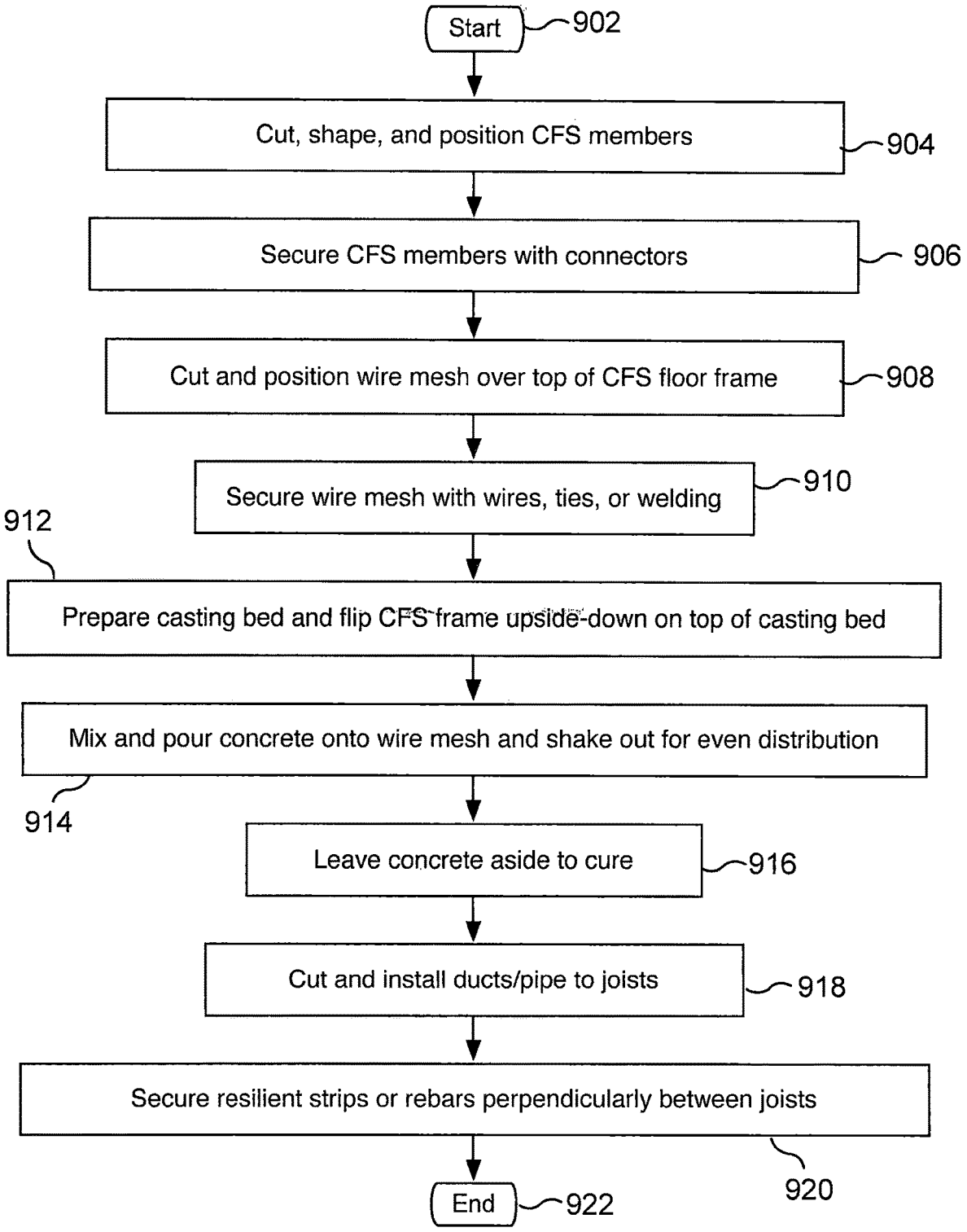
FIG. 9 outlines a flowchart that details the manufacturing process of the composite slab according to the preferred embodiment described in this invention.

FIG. 9 provides a flowchart detailing the construction process of a Cold-Formed Steel (CFS) and Wire-mesh-Reinforced Concrete Composite Slab. 902 indicates the start of the process. Step 904 involves cutting, shaping, and positioning CFS members according to the design specifications of the slab. Specifically, the joists and blocking plates are cut and shaped from steel sheets using a cold-forming process in a factory, which involves rolling or pressing steel into the desired profile at room temperature. The cutting may involve a sheering process for metal. The shaping may involve a metal bending process. Especially in the production of the present disclosure, the joists and blocking plates can be manufactured in pairs at the same time to improve production efficiency and reduce the material waste rate. For example, when cutting one piece of joist, another same joist can be planned and positioned in a left-right fashion with finger connectors interlaced and notched into each other's space between two adjacent fingers. In this way, one cutting produces two joists or blocking plates, and the wasted steel material is greatly minimized. At the same time, utility holes or apertures are also cut and shaped. HVAC pipes are manufactured and prepared ready for installation.

Step 906 details Securing the CFS members. To secure Cold-Formed Steel (CFS) members, various methods such as screwing, riveting, or welding can be employed. However, spot welding is the preferred method, especially for T joints. Angle steel connectors are utilized for this purpose. First, the welding equipment should be set up as per the specifications and be suitable for spot welding of cold-formed steel. Ensure the welding parameters are appropriately adjusted. Then, proceed to perform spot welding along the contact points between the angle steel connector and the CFS joists. Use welding electrode tips to create spot welds at regular intervals along the length of the bracket, ensuring adequate fusion and penetration. This ensures a secure and robust connection between the CFS members and the angle steel connectors.

Step 908 describes cutting and positioning wire mesh to cover the top of the CFS slab frame, which will later be embedded in Wire-Mesh-Reinforced concrete. The wire mesh normally is made of steel wires. Wire mesh requires welding techniques like TIG, NIG, or spot welding to join the wires at their intersections. For the purposes of this invention, spot welding is the most economical and efficient option. The wire must be straight, and the wire mesh must match the entire area of the concrete board.

Step 910 details securing the wire mesh with wires, ties, or welding to ensure it remains in place during the concrete pour. Put the wire mesh on the top of the fingers of the joists and blocking plates. It is advisable to secure the wire mesh in an accurate place and position using annealed steel wire. Light welding and ties are also okay but are optional.

Step 912 shows the preparation of a casting bed and the flipping of the CFS frame upside-down, on top of the casting bed, ready for concrete application. The casting bed is prepared and ready to be filled with wet concrete. The previously cut, shaped, and positioned CFS frame with wire mesh covered on its top will be flipped over to be upside-down above the concrete casting bed. The CFS frame will be leveled precisely and lowered slowly into the casting bed until the wire mesh and finger connectors are fully below the planned concrete filling line.

Step 914 is to mix and pour concrete into the casting bed. A mixture of concrete infused with reinforcing fibers is preferred. The fibers, which could be made of various materials such as glass, steel, or synthetic polymers, are evenly dispersed throughout the concrete to provide additional tensile strength and reduce the likelihood of cracking. Then, the interlocked structure with wire mesh and finger connectors is dipped into this composite material until they are fully immersed to ensure thorough coverage and adherence to the steel. The casting bed is then shaken well for even distribution of the concrete in it and leveled to create a flat surface.

Step 916 is the curing step, where the concrete is left to harden and gain strength. This normally takes 24 to 48 hours or longer. Steaming is an optional technique for accelerating the hydration process of concrete during curing. It involves the application of high-pressure steam to the newly placed concrete to speed up its strength development and decrease curing time.

Step 918 includes cutting and installing ducts or pipes to the joists, which are part of the utility's integration within the slab. The previously prepared HVAC pipes are now cut into desired lengths and installed to the joists/blocking plates inside the slabs through longitude and latitude utility holes/apertures on the joists and blocking plates, ensuring an integrated structural and climate control system.

In step 920, the installation of resilient strips or resilient strip clips is carried out, positioned perpendicularly between joists to enhance soundproofing. The concluding phase of the assembly is indicated by step 922, thereby completing the construction process. The flowchart provided delineates each pivotal stage in the assembly of the composite slab, underscoring the significance of the precise sequence and techniques employed to guarantee superior structural efficacy. It should be noted that FIG. 9 is illustrative rather than prescriptive. The current disclosure encompasses any alterations, whether it be the exclusion or inclusion of steps or the rearrangement of certain steps, that a practitioner with ordinary skill in the field might conceive.

This new composite slab technology leverages the benefits of cold-formed steel, Wire-Mesh-Reinforced concrete, and novel top finger connectors, resulting in a building material that is robust, lightweight, and versatile. It is particularly favored in modern construction projects where efficiency, longevity, and structural performance are paramount. The manufacturing process is subject to continuous improvement and innovation to meet the evolving demands of the construction industry.

The invention claimed is:

1. A composite slab, comprising:

a plurality of cold-formed steel (CFS) joists arranged in parallel, each CFS joist being formed from a steel sheet by a cold-forming process and including a web, a bottom flange, and a top portion without a traditional top flange;

a plurality of cold-formed steel (CFS) blocking plates extending perpendicular to and between adjacent ones of the plurality of CFS joists, each CFS blocking plate being formed from a steel sheet by a cold-forming process and including a middle web, a bottom flange, and a top portion without a traditional top flange;

a plurality of finger connectors integrally formed along the top portions of the CFS joists and along the top portions of the CFS blocking plates, the finger connectors being arranged along the CFS joists and the CFS blocking plates;

a wire mesh positioned at the top portions of the CFS joists and the top portions of the CFS blocking plates and secured by at least some of the finger connectors; and a concrete layer directly cast onto the top portions of the CFS joists, the top portions of the CFS blocking plates, and the wire mesh, wherein the finger connectors of both the CFS joists and the CFS blocking plates are embedded in the concrete layer and mechanically interlock the CFS joists, the CFS blocking plates, the wire mesh, and the concrete layer together, wherein the concrete layer forms an upper compression layer in place of the omitted traditional top flanges of both the CFS joists and the CFS blocking plates, and wherein the CFS joists and the CFS blocking plates define a two-directional waffle support structure.

2. The composite slab of claim 1, wherein the concrete layer includes a dispersion of reinforcing fibers selected from a group consisting of glass, steel, synthetic polymers, or a combination thereof.

3. The composite slab of claim 1, wherein the CFS blocking plates are arranged between adjacent CFS joists at denser repeated intervals along lengths of the CFS joists, and wherein each CFS blocking plate provides transverse load-distributing support between the adjacent CFS joists.

4. The composite slab of claim 1, wherein the bottom flange beneath the blocking plate is reliably connected to the bottom flange beneath the joist including through welding and by using a full-length U-shaped steel for reinforcement.

5. The composite slab of claim 1, wherein the finger connectors are arranged in a dense uniform distribution along the top portions of the CFS joists and the CFS blocking plates.

6. The composite slab of claim 1, wherein the CFS joists and the CFS blocking plates include utility holes in middle of their webs configured to receive HVAC pipes within the composite slab; wherein the utility holes and the HVAC pipes are at regular intervals; wherein the HVAC pipes are welded, riveted, or screwed to the CFS joists or the CFS blocking plates for added rigidity.

7. The composite slab of claim 1, further comprising a resilient strip secured adjacent to a bottom side of the composite slab to improve acoustic performance.

8. The composite slab of claim 1, wherein each CFS joist has a C-shaped cross-sectional profile.

9. The composite slab of claim 1, wherein the bottom flange of at least one CFS joist is a double bottom flange formed from a C-shaped joist and a lipped steel angle attached together to define a generally upside-down T-shaped cross-sectional profile.

10. The composite slab of claim 1, wherein the finger connectors include at least one of a wave shape, an L shape, a flipped L shape, a T shape, a flipped T shape, or a slotted shape.

11. The composite slab of claim 1, wherein the wire mesh is made of steel, fiberglass, or a combination thereof.

12. The composite slab of claim 1, wherein the CFS joists are manufactured using a material selected from a group consisting of galvanized steel, stainless steel, or a coated alloy.

13. The composite slab of claim 1, wherein the CFS slab includes a balcony deck created by installing balcony joists beside the CFS slab.

14. The composite slab of claim 13, wherein the balcony deck has balcony joists, balcony rim joists, and rebars embedded in the balcony concrete board.

15. A method of manufacturing the composite slab of claim 1, comprising:

forming a plurality of cold-formed steel (CFS) joists from steel sheets, each CFS joist including a web, a bottom flange, and a top portion without a traditional top flange;

forming a plurality of cold-formed steel (CFS) blocking plates from steel sheets, each CFS blocking plate including a web, a bottom flange, and a top portion without a traditional top flange;

forming a plurality of finger connectors along the top portions of the CFS joists and the CFS blocking plates, wherein the finger connectors are formed in place of the omitted traditional top flanges;

arranging the CFS joists in parallel;

arranging the CFS blocking plates perpendicular to and between adjacent ones of the CFS joists to form a CFS slab frame;

positioning a wire mesh at the top portions of the CFS joists and the CFS blocking plates and securing the wire mesh with at least some of the finger connectors; and directly casting a concrete layer onto the top portions of the CFS joists, the top portions of the CFS blocking plates, and the wire mesh such that the finger connectors of both the CFS joists and the CFS blocking plates are embedded in the concrete layer and mechanically interlock the CFS joists, the CFS blocking plates, the wire mesh, and the concrete layer together, wherein the concrete layer forms an upper compression layer in place of the omitted traditional top flanges of both the CFS joists and the CFS blocking plates, and wherein the CFS joists and the CFS blocking plates define a two-directional waffle support structure.

16. The method of claim 15, wherein arranging the CFS blocking plates comprises arranging the CFS blocking plates between adjacent CFS joists at repeated intervals along lengths of the CFS joists such that each CFS blocking plate provides transverse load-distributing support between the adjacent CFS joists.

17. The method of manufacturing a composite slab of claim 15, further comprising:

preparing and leveling a casting bed;

flipping the CFS slab frame upside down and positioning the CFS slab frame over the casting bed such that the top portions of the CFS joists and the CFS blocking plates face the casting bed;

pouring the concrete layer into the casting bed to encapsulate the finger connectors of both the CFS joists and the CFS blocking plates;

shaking or vibrating the poured concrete layer to distribute the concrete around the finger connectors and the wire mesh; and curing the poured concrete layer to form the composite slab.

18. The method of claim 15, further comprising:

forming utility holes in the webs of the CFS joists and the CFS blocking plates;

installing HVAC ducts or pipes through the utility holes; and mechanically fixing the HVAC ducts or pipes to at least one of the CFS joists or the CFS blocking plates so that the HVAC ducts or pipes provide added rigidity to the composite slab.

19. The method of claim 15, wherein forming the plurality of finger connectors comprises forming the finger connectors in a uniform distribution along the top portions of the CFS joists and the CFS blocking plates, and wherein the finger connectors include at least one of a wave shape, an L shape, a flipped L shape, a T shape, a flipped T shape, or a slotted shape.

20. The method of claim 15, wherein the bottom flange is a double bottom-flange consisting of two components: a further comprising forming at least one CFS joist with a double bottom flange by attaching a lipped steel angle to a C-shaped joist to define a generally upside-down T-shaped cross-sectional profile, or forming a balcony deck by installing balcony joists adjacent to the CFS slab frame.

* * * * *